United States Patent [19]

Zurlinden, III et al.

[11] 4,238,879

[45] Dec. 16, 1980

[54] LAMINATED INDUCTOR STACKING AND CALIBRATING APPARATUS

[76] Inventors: Cyril P. Zurlinden, III, 5635 Pineglen Rd., La Crescenta, Calif. 91214; Charles W. Howe, 8259 Kyle St., Sunland, Calif. 91040; John M. Podry, 4953 Del Monte Rd., La Canada, Calif. 91011

[21] Appl. No.: 933,992

[22] Filed: Aug. 16, 1978

[51] Int. Cl.[2] ..... H01F 41/02

[52] U.S. Cl. ..... 29/705; 29/593; 29/606; 29/609; 29/738

[58] Field of Search ..... 29/705, 738, 609, 593, 29/606

[56] References Cited

U.S. PATENT DOCUMENTS

| | | | |
|---|---|---|---|
| 2,055,175 | 9/1936 | Franz | 29/738 X |
| 2,658,268 | 11/1953 | Knauf, Jr. et al. | 29/609 X |

FOREIGN PATENT DOCUMENTS

| | | | |
|---|---|---|---|
| 448549 | 5/1948 | Canada | 29/609 |

*Primary Examiner*—Carl E. Hall

*Attorney, Agent, or Firm*—Smyth, Pavitt, Siegemund, Jones & Martella

[57] ABSTRACT

A method for manually assembling an inductor and calibrating it, and apparatus to facilitate practice of the method. Laminations are manually inserted into the ends of a hollow core of a wire-wound bobbin to build up a right hand stack of laminations and a left hand stack of laminations. Manual insertion of the laminations is facilitated by use of a stacking block which includes upright indexing posts to promote registration of the laminations. The left and right laminations are so stacked that an oversize air gap is included between the right hand stack and the left hand stack. After all the laminations have been stacked, the inductor is placed on a calibrator bed to facilitate calibration. The calibrator bed includes first and second sets of jaws which are closed along orthogonal directions under control of an operator. Closure of the first set of jaws brings the laminations into registration. The inductor is then connected electrically to an impedance comparator meter which has a display for indicating the difference in inductance between the inductor being calibrated and a standard inductor. Next, the second set of jaws is closed, forcing the right hand and left hand stacks of inductors together, narrowing the air gap. The operator watches the impedance comparator meter while moving the second set of jaws and continues to narrow the air gap until the meter indicates the inductances to be matched exactly. Thereafter, the inductor is removed from the calibrator bed and the laminations are bonded together.

9 Claims, 11 Drawing Figures

FIRST LAYER
THIRD LAYER

SECOND LAYER
FOURTH LAYER 42
52
LEFT
26
REAR
22
56
24
44
48
FRONT
RIGHT
50
74
46
54

REAR 46
22
56
24
44
48
LEFT
RIGHT
48'
44
26
54
FRONT
74
50

50
74
74
76
54
42
70
68
72
46
64
62
66

50
74
54
76
42
46
70
68
72
64
62
66

LAMINATED INDUCTOR STACKING AND CALIBRATING APPARATUS

BACKGROUND OF THE INVENTION

1. Field of the Invention

The present invention is in the field of electrical inductors, and more specifically relates to apparatus for assembling and for electrically calibrating laminated core inductors.

2. The Prior Art

In U.S. Pat. No. 2,055,175, issued Sept. 22, 1936 to Franz, there is shown a method and apparatus for making laminated cores and for adjusting them.

Two separated stacks of E-shaped laminations are built up, and the laminations of each stack are held together by a coating of adhesive applied to the exposed edges of the laminations. The adhesive is described as being a viscous and relatively quick-drying cement sufficiently thick and viscous not to be drawn in between the laminations by capillary attraction, but to remain on and adherent only to the edges of the laminations. The adhesive permits the stacks of laminations to be handled as self-coherent units. The lamination of the two stacks do no overlap. Franz does not disclose apparatus to facilitate stacking of the laminations. The two stacks of laminations are used as the two halves of the core of the inductor.

The inductor includes, in addition to the stacks of laminations, a coil which has been wound on a spool. As described in the Franz patent, a mass of still-viscous adhesive is placed inside the spool, and the central legs of the E-shaped stacks are then inserted into the spool from opposite ends. An air gap is left between the ends of the legs.

The assembly is then placed in an apparatus which includes a pair of wedges which are used in a controlled manner to force the stacks of laminations apart until the desired electrical characteristic is achieved. Franz does not describe the electrical calibration apparatus and method used, but merely states that a testing circuit is employed to determine when the mutual inductance of the windings takes on its desired value as the core halves are driven apart by the wedges. Thereafter, the assembled and calibrated inductor is left in the calibrating apparatus so that the wedges of that apparatus will resist the tendency of the adhesive to draw the core halves together as the adhesive dries. After the adhesive has dried, the finished coil is removed from the calibrating apparatus.

The method disclosed by Franz produces inductors at an unacceptably low rate because the inductors must remain within the apparatus until the adhesive has set, as taught by Franz. The present invention is based on a discovery which overcomes the limited production rate.

In U.S. Pat. No. 3,820,238, issued June 28, 1974 to Caputo et al. there is disclosed a method of constructing inductors using F-shaped laminations. The laminations are bolted together in spite of the admonition of Franz that mechanical compression of the laminations tends to adversely affect the permeability of the core.

In accordance with the method disclosed by Caputo et al., the laminations forming the opposite halves of the core are interleaved but with the portions of the laminations defining the air gap spaced apart sufficiently that a spool bearing the winding can be inserted between those portions. Next, the laminations forming each of the halves of the core are bolted together, so that the opposite halves of the core each can be moved as a unit. Thereafter, the coil-bearing spool is positioned in the air gap and the opposing halves of the core are pressed together, narrowing the air gap. Caputo et al. do not disclose an electrical means for determining when the proper air gap has been achieved. After the air gap has been adjusted, the laminations are clamped together by tightening the superposed laminations with nuts disposed on bolts.

The range of inductance values which can be obtained with the method of Caputo et al. is severely limited by the bolt holes in the laminations, which determine the width of the air gap. This, combined with the absence of any means for calibrating the inductance of the unit electrically, indicates that Caputo et al. are mainly concerned with assembling non-precision inductors having an inductance determined by the spacing of the holes in the laminations, rather than inductors having a precisely calibrated inductance determined by controlled adjustment of the air gap.

In U.S. Pat. No. 3,355,689, issued Nov. 28, 1967 to Paddison et al., there is shown a core formed of laminations having slots and holes in them to permit adjustment of the air gap.

The laminated core is stacked within the spool. Paddison et al. do not disclose apparatus to facilitate stacking of the laminations. The assembled coil is then adjusted by means of a screwdriver-like tool which alters its electrical properties as desired. Paddison et al. state that calibration of the electromagnet is effected by applying and measuring a voltage and a current to the coil while simultaneously adjusting the air gap with the special tool. After the coil has been calibrated, the laminations are bolted together. The method used by Paddison et al. requires that the laminations be provided with holes of the proper size, shape and location and does not lend itself to the production of precision inductors because the laminations are bolted together after the calibration is performed, and this tends to introduce inaccuracies.

Thus, it is seen that none of the methods known to the prior art is entirely satisfactory from the standpoint of ease of production or accuracy of calibration.

Machines for automatically stacking laminations are disclosed in U.S. Pat. No. 3,423,814 to Davis, U.S. Pat. No. 3,634,919 to Nieder, and U.S. Pat. No. 3,798,735 to Macchione. Machines of this type have a tendency to jam. With some of the machines it is not possible to stack more than, say, 90 percent of the laminations; the remaining laminations have to be inserted by hand.

As will become apparent, the present invention is not a machine for automatically stacking laminations. Instead, the present invention includes a fixture to facilitate manual stacking and calibration.

SUMMARY OF THE INVENTION

The present invention encompasses apparatus and a method for producing a laminated core inductor having an inductance very accurately matching that of a standard inductor. The invention will be described as operating on laminations in the form of thin sheets of steel having the shape of the letter "F", although other shapes can be used. A coil of wire is wound on a small plastic spool or reel and the wound spool is called a bobbin. A predetermined number of windings are used so that the bobbin will have desired electrical characteristics, at least to a low degree of accuracy.

The present invention includes three major steps. First, interleaved stacks of laminations are built up within the core of the bobbin; and second, the laminations are carefully manipulated to fine-tune the inductance. Thereafter, the laminations are bonded together.

Insertion of the laminations into the bobbin is facilitated by a fixture called a stacking block. In its most elementary form, the stacking block includes a generally planar top surface. This top surface has a central aperture or depression into which the bobbin is partially inserted with its hollow core extending horizontally, for example from left to right. The depression is of a predetermined depth to position the bobbin so that the lowest lamination to be inserted into the core will lie flush against the planar top surface of the starting block. The lowest pair of laminations is inserted first, the central arms of the F-shaped laminations being inserted from the left and right respectively into the hollow core of the bobbin. Four posts extend vertically from the planar top surface of the stacking block, two on the left of the central depression and two on the right of it. These posts are far enough apart from front to back to permit the central arms of the F-shaped laminations to pass between them as the laminations are inserted. The vertical surfaces of the posts are angled or curved so that as the central arm of each lamination is inserted between the posts, the central arm is guided laterally to register rather accurately with the previously-stacked laminations. Also, the spacing of the posts from left to right determines how far into the core of the bobbin the laminations can be inserted. In a later step the inductance of the laminated core coil will be given a fine adjustment by gradually pushing the stacked laminations further into the core in a controlled manner, thereby closing the air gap between the central F-arms extending into the hollow core from the left and right sides.

After the first pair of laminations has been inserted, a second pair of laminations is inserted into the core on top of the first pair. The second pair is oriented to form a pattern which is a mirror image of the pattern formed by the first pair, but because of the indexing effect of posts, the second pair occupies the rectangular space directly above the first pair, as will be clarified by reference to the accompanying drawings. The additional pairs of laminations are inserted in succession, the orientation alternating in alternate layers, until all of the laminations have been inserted, the core totally filled and a friction-tight block formed.

Insertion of the successive layers of laminations by an operator is facilitated in a preferred embodiment, by pre-arranging four stacks of laminations at the corners of a rectangle about the stacking block. The laminations in these stacks are already oriented in the particular directions they will occupy when inserted into the core so that it is not necessary for the operator to turn each individual lamination to the desired position. The operator merely picks up with his left and right hands simultaneously a lamination from each of the rear stacks, inserts them, then simultaneously picks up a lamination from each of the front stacks, inserts them, then repeats the process, picking from the front and rear stacks alternately.

Once all of the laminations have been inserted into the bobbin on the stacking block, the resulting assembly is plucked from the stacking block for insertion into a different apparatus called a calibrator bed. In an alternative embodiment described below, the stacking block is integrated into the calibrator bed, and this permits the calibration to be carried out without removing the assembly from the central depression. At this stage, the laminations have not yet been bonded together or attached to the bobbin, yet the laminations hold their relative positions unless roughly handled, because of the overlapping of the alternating successive layers and the friction between them.

The calibrator bed, like the stacking block, includes a planar surface having a central depression or aperture. The bobbin assembly is lowered into this depression in the same position it had on the stacking block, that is, with the lowest lamination flush with the planar surface and supported by the portion of the planar surface surrounding the aperture. The axis of the bobbin extends from left to right in the following description.

Mounted to ride across the planar surface are two sets of jaws. The first set is operable to converge on the stacked laminations from the front and rear, and the second set is operable to converge on the stacked laminations from the left and right.

The procedure for precisely adjusting the inductance of the coil is as follows. After the coil has been placed in position on the planar surface, the wires which are the ends of the winding are connected to an impedance comparator meter. A standard coil having the desired inductance is also connected to the meter to serve as a reference. The meter has a needle which indicates the difference in inductance between the two coils. An operator watches the needle while controlling the jaws to reduce the difference to zero.

First, the jaws of the first set are brought together to shift the layers of laminations into registration in the front-to-rear direction. After being brought firmly together against the laminations, the jaws of the first set are opened slightly so as to contact the laminations in a close but slidable engagement. The jaws of the second set are then gradually closed by the operator, driving the laminations together from the left and right, while the first set of jaws maintains registration of the stack in the front-to-rear direction. As the jaws of the second set are brought together, the operator monitors the needle and stops the second set of jaws when the needle indicates the inductances to be matched.

It has been found that the laminations maintain the relative positions imparted if handled with ordinary care. After the inductances have been matched, both sets of jaws are opened, the wires are disconnected, the assembly is plucked from the calibrator bed, and the laminations are bonded together by applying a stripe of bonding liquid to the edge of the stack of laminations. The bonding liquid is a high-strength anaerobic cyanoacrylat such as that marketed as Type 420-61 by the Loctite Corporation of Newington, Conn. The bonding liquid chosen has low viscosity so that it will penetrate between the laminations and it sets at room temperature in approximately 20 seconds.

The assembly is removed from the calibrator before the adhesive is applied, and it is not necessary to wait for the adhesive to set before calibrating the next assembly. If desired, a number of assemblies can be calibrated and set aside for application of the adhesive at a later time; this saves time if the coils are being produced by one worker. Alternatively, it permits a first worker to calibrate while a second worker applies the adhesive.

Simple as the invention may appear in hindsight, it has proven remarkably effective in practice. In production, coils can be calibrated to an accuracy of better than 1 percent at a sustained rate of 150 per hour per operator. Increased accuracy, not presently required, can be achieved with only a modest reduction in the rate. Because of its low capital cost, high speed, accuracy, and low labor cost, the present invention is having a decided impact on the industry, giving domestic producers an advantage over foreign producers despite the lower labor costs abroad.

Several refinements have been used in practising the present invention. In one refinement, the stacking block is provided with a lever-operated plunger which can be activated selectively by the operator to thrust upwardly from a normal position under the bobbin to facilitate removal of it from the stacking block.

In another refinement, the second set of jaws is provided with both a coarse control and a fine control. During the calibration procedure, when the operator determines from the position of the needle that the null condition is being approached, he changes from the coarse control to the fine control to advance the jaws of the second set in a more gradual and more precisely controllable manner. In one embodiment, one revolution of the fine control closes the jaws of the second set by 0.003 inches.

Another refinement is the provision of an electrical terminal block affixed to the planar surface of the calibrator, out of the way of the jaws, to facilitate connecting the normally relatively short ends of the coil winding to the impedance comparator. The block is provided with clips for gripping the ends of the coil winding, and these clips are connected to leads running to the impedance comparator.

In an alternative embodiment, the stacking block is integrated into the comparator to avoid duplication of their common elements. In this embodiment, the comparator bed is provided with downwardly retractable posts. These posts are otherwise similar in structure, arrangement and function to the posts of the stacking block. A foot pedal is connected to the posts for controlling their elevating and retracting. It should be noted, however, that this embodiment does not necessarily result in the greatest production rate, since it usually is more efficient to have two operators, one stacking laminations on a stacking block, while the other calibrates the inductors.

In another refinement, greater accuracy can be achieved by using the varying inductance of the coil being calibrated to control the frequency of an oscillator signal. This signal is continuously combined with a signal of fixed frequency produced by a standard oscillator to produce a beat frequency signal which is monitored by the operator by visual and/or aural presentations.

Although the invention has been described and illustrated with reference to F-shaped laminations, it will be apparent to those skilled in the art that the present invention could be modified for use with laminations of other shapes such as the LE and EE laminations known in the art.

Three aspects of the present invention run the risk of being overlooked, unless mentioned here, because of their subtle nature.

First, in accordance with the present invention, it is not necessary that any holes be produced in the laminations. This minimizes the cost of the laminations.

Second, the present invention permits coils to be made to a wide range of inductance values from laminations of a single basic size and shape. The apparatus of the present invention permits the air gap to be controlled over a wide range.

Third, in accordance with the present invention, the air gap of each coil is not adjusted until the measured inductance reaches a desired value; instead, the air gap is adjusted until all measurable difference between the inductance of each coil and that of a standard coil under the same conditions has been nulled out. The nulling technique used in the present invention insures that the coils produced over long periods of time and under widely varying conditions will consistently be identical electrically to the standard coil.

It will also be apparent to those skilled in the art that the workpiece upon which the present invention operates is not limited to inductors, and could include transformers, for example.

The novel features which are believed to characterize the invention both as to structure and method of operation, as well as further objects and advantages will be better understood from the following drawings in which a preferred embodiment of the invention is illustrated by way of example. It is to be understood, however, that the drawings are for the purpose of illustration and description only and are not intended as a definition of the limits of the invention.

DETAILED DESCRIPTION OF THE PREFERRED EMBODIMENT

Figure 1:
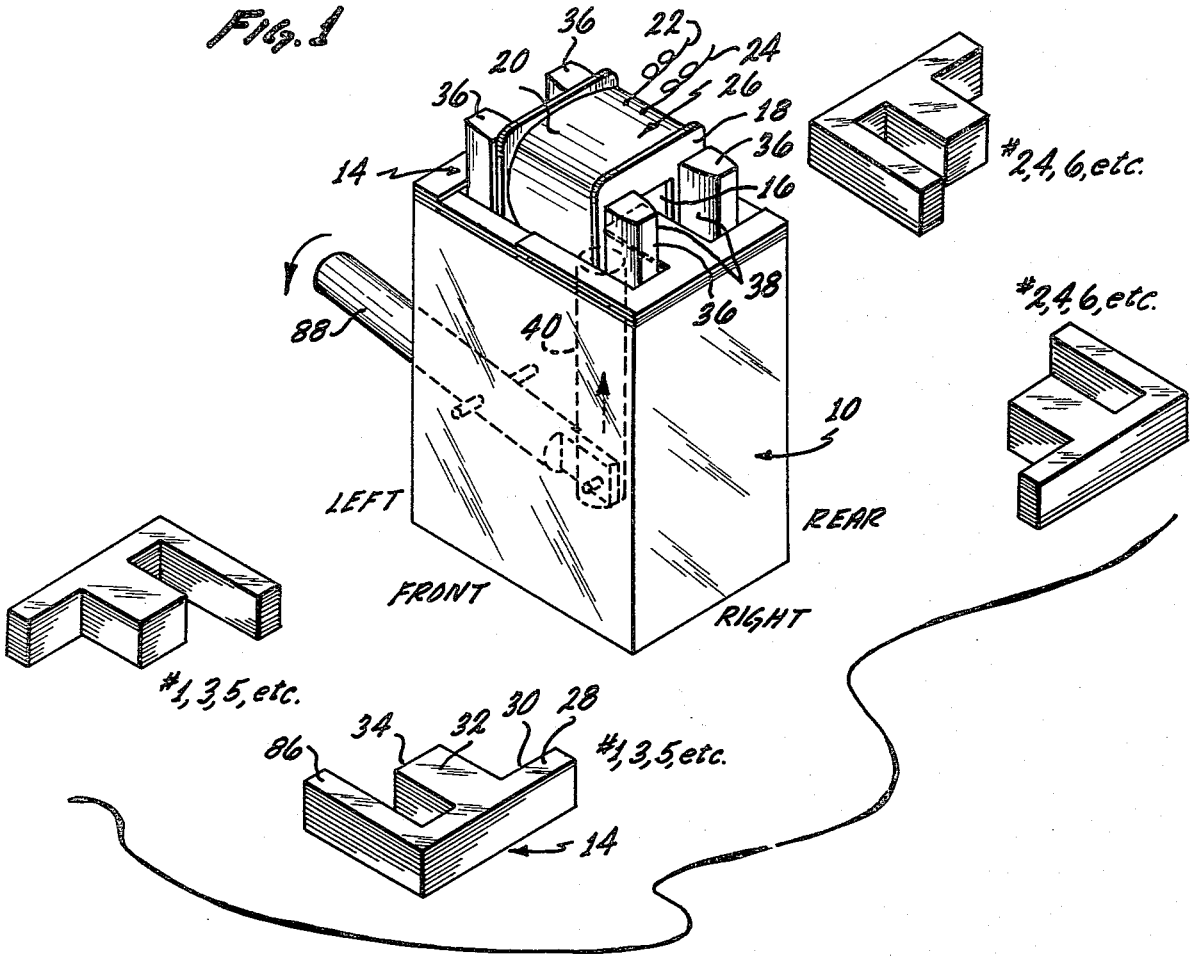
FIG. 1 is a perspective view of a preferred embodiment of the stacking block of the present invention.
Figure 2A:
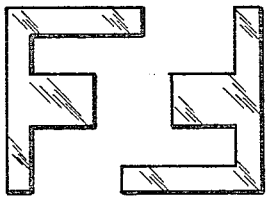
FIG. 2*a* is a diagram showing the orientation of the laminations in the odd-numbered layers.
Figure 2B:
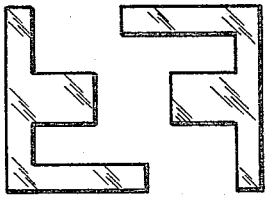
FIG. 2*b* is a diagram showing the orientation of the laminations in the even numbered layers.

Turning now to the drawings in which like parts are denoted by the same reference numeral, there is shown in FIG. 1 a perspective view of the stacking block 10 of the present invention. The stacking block 10 includes a substantially flat upper surface 12 on which the laminations 14 rest after they have been inserted into the core 16 of the bobbin 18.

The bobbin 18 includes a winding 20 of wire, and the ends of the winding 22, 24 are accessible. FIG. 1 shows an intermediate stage in the stacking of the laminations in an inductor 26. The method employed for stacking the inductor will be described below.

The laminations 14 include a body 28 having an edge 30 from which an arm 32 extends. The end 34 of the arm defines the air gap when the laminations 14 have been inserted into the inductor 26.

The stacking block 10 further includes four vertically-extending indexing posts 36 which serve to define the position of the laminations when they are inserted to assure registration of the laminations. The vertical surfaces 38 of the indexing post 36 facing the arm 32 of the laminations are tapered to facilitate insertion of the arm 32 between the indexing posts 36 and to guide the laminations into registration with the previously-stacked laminations.

The stacking block 10 further includes a plunger 40 which can be thrust upwardly to eject the inductor 26 from the stacking block when the stacking process has been completed.

Figure 3:
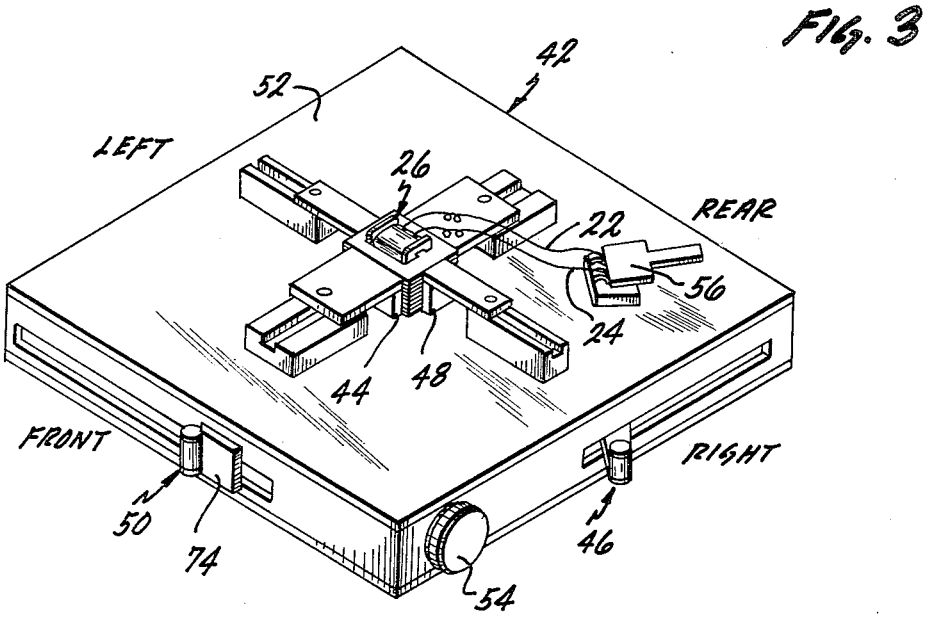
FIG. 3 is a perspective view of the calibrator bed in a preferred embodiment of the present invention.
Figure 4:
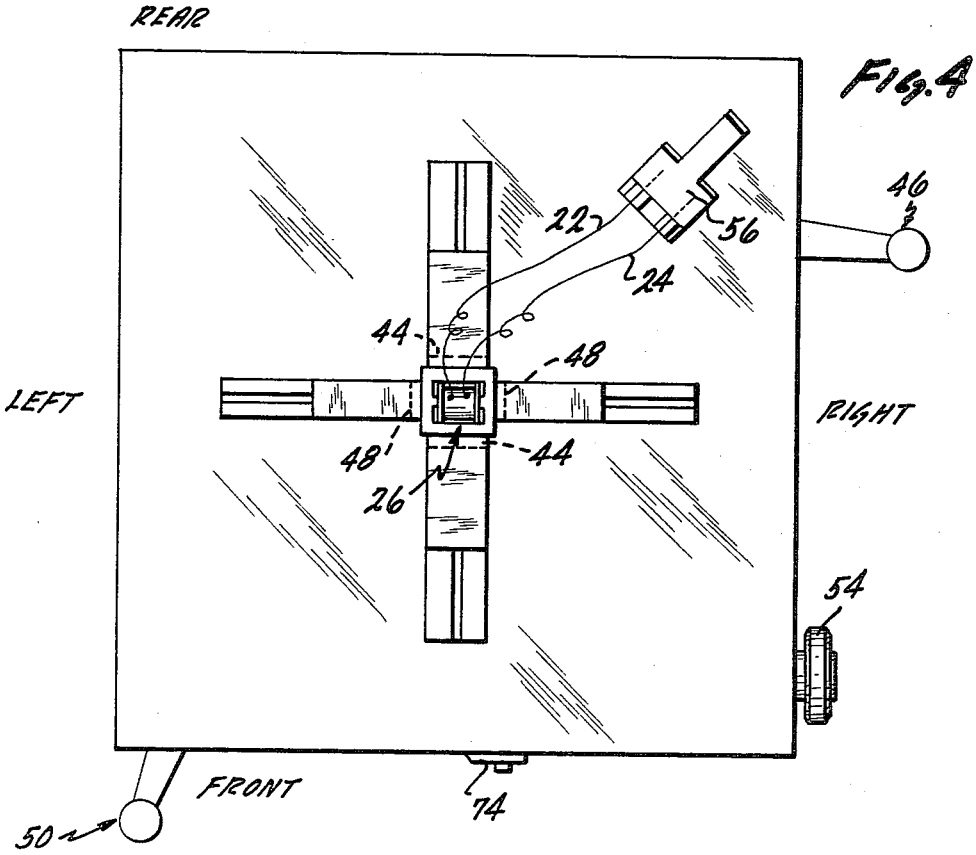
FIG. 4 is a top view of the calibrator bed of FIG. 3.

FIGS. 3 and 4 show, respectively, a perspective view and a top view of a calibrator bed in accordance with a preferred embodiment of the present invention. The calibrator bed serves to bring the edges of the lamination into registration and to reduce the air gap in a precisely-controlled manner to trim the inductance to a value equal to that of a standard inductor.

As shown in FIGS. 3 and 4, the calibrator bed includes a first set of jaws 44 which are opened and closed by the handle 46. The calibrator bed 42 further includes a second of jaws 48 controlled by the handle 50.

The first set of jaws 44 and the second set of jaws 48 ride along the substantially flat surface 52 of the calibrator bed 42 so as to engage all of the laminations from the bottom lamination to the top lamination of the stack of laminations included in the inductor 26.

A fine control knob 54 is provided to permit the operator to move the handle 50 with even greater precision of control when closing the second set of jaws to adjust the air gap of the inductor 26.

The calibrator bed 42, in a preferred embodiment, further includes an electrical connector block 56 for use in connecting the inductor 26 electrically to an impedance comparator meter 58 (shown in FIG. 8) which includes a standard inductor 60. In a preferred embodiment, the impedance comparator meter 58 is an Iteco Impedance Comparator Model 1010 made by the Industrial Equipment Company of Port Washington, N.Y.

Figure 5:
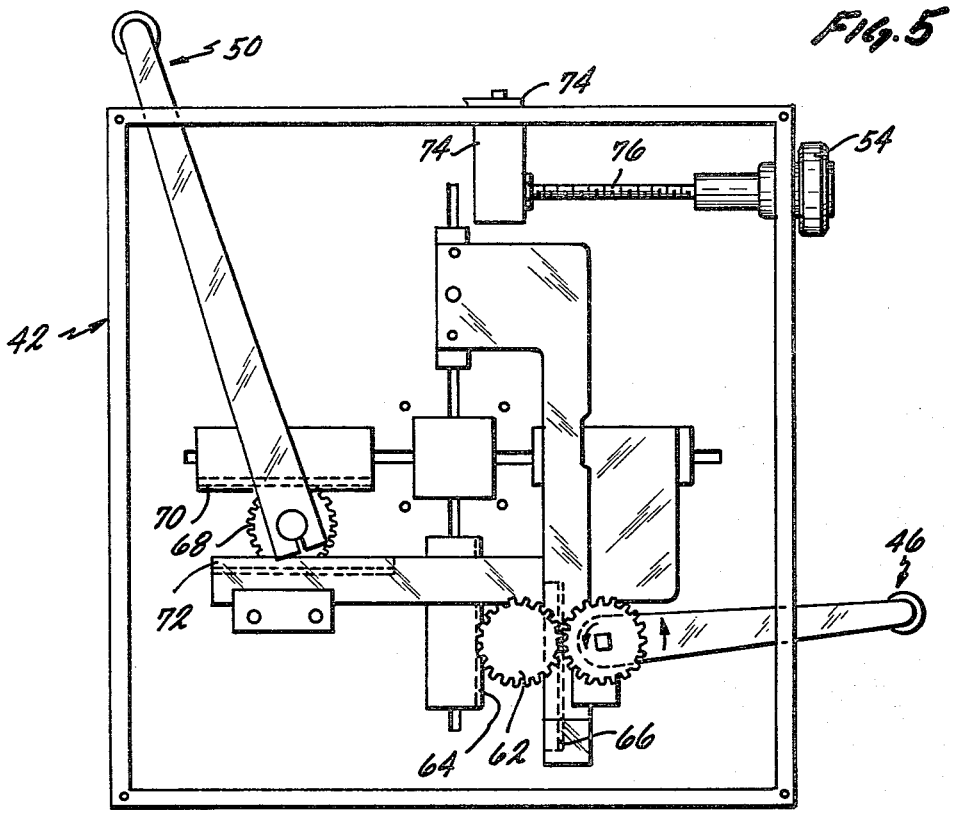
FIGS. 5 and 6 are bottom views of the calibrator bed of FIG. 3 showing the jaws in the open and closed positions, respectively.
Figure 6:
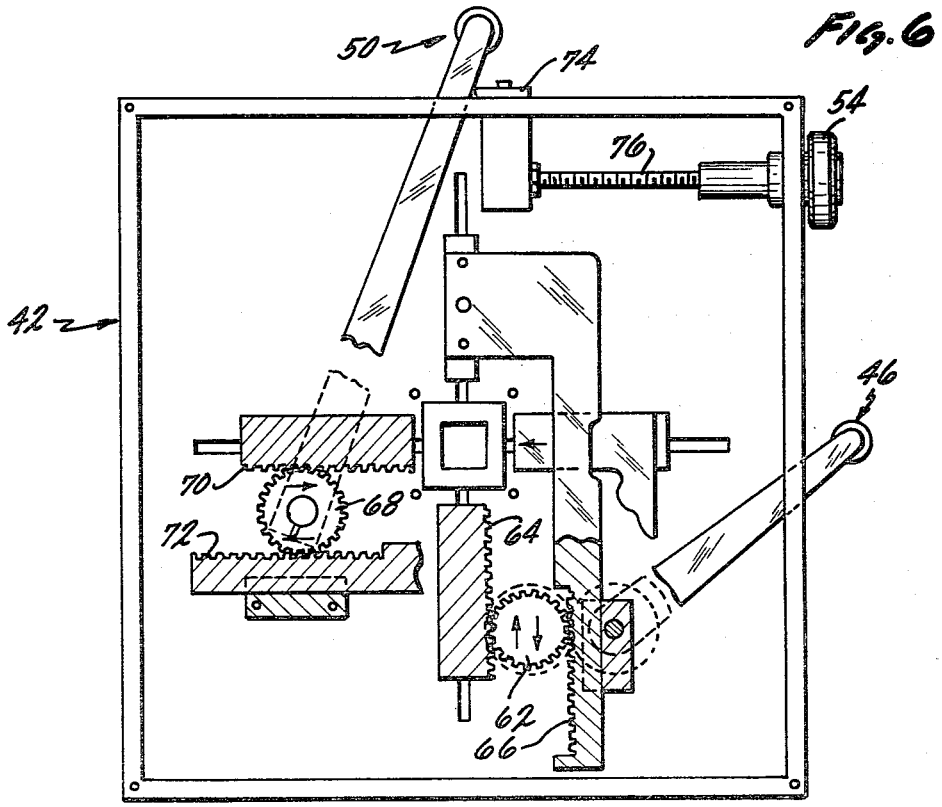

FIGS. 5 and 6 are bottom views of the calibrator bed 42 showing the mechanism used for opening and closing the sets of jaws. FIG. 5 shows the calibrator bed 42 with the jaws in their open positions, while FIG. 6 shows the jaws in their closed positions.

The first set of jaws 44 is controlled by the handle 46 which serves to turn the pinion 62 which drives the racks 64, 66 in opposite directions to open and close the first set of jaws 44.

Similarly, the second set of jaws 48 is controlled by the handle 50 which turns the pinion 68 which moves the racks 70, 72 to which the jaws of the second set are connected. Movement of the handle 50 from its position shown in FIG. 5 to the position shown in FIG. 6 closes the second set of jaws narrowing the air gap in the inductor. The motion of the handle 50 is intercepted as shown in FIG. 6 by the block 74. The position of the block 74 is adjustable by means of the fine control knob 54 which rotates a screw 76 to move the block 74. In one embodiment of the present invention, the block 74 is positioned so that the handle 50 is intercepted by the block 74 before the air gap is narrowed to its final width. Thereafter, the operator holds the handle 50 against the block 74 while rotating the fine control knob 54 to narrow the air gap in a more gradual and more precise manner to its final width. If desired, the block 74 may be positioned sufficiently far to the right in FIG. 6 that it is not effective, and in this case, the adjustment of the air gap is performed solely by use of the handle 50.

Figure 7:
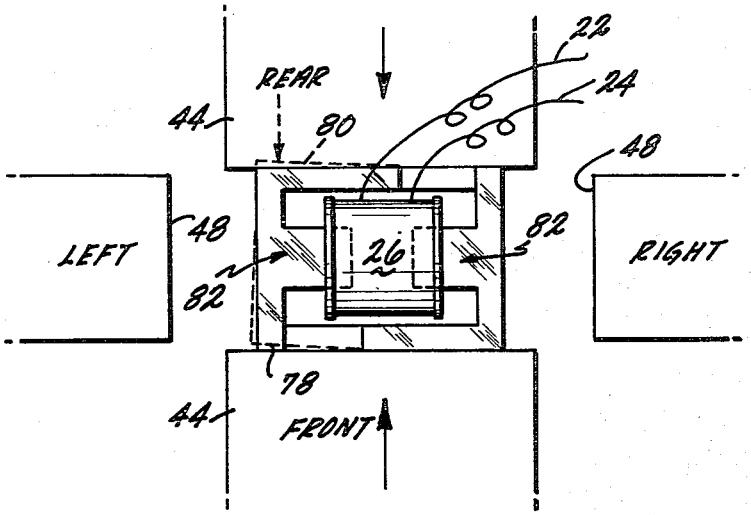
FIG. 7 is a diagram of a top view of the calibrator bed showing the first set of jaws closed against the laminations to bring the front edges of the laminations into registration and to bring the rear edges of the laminations into registration.
Figure 8:
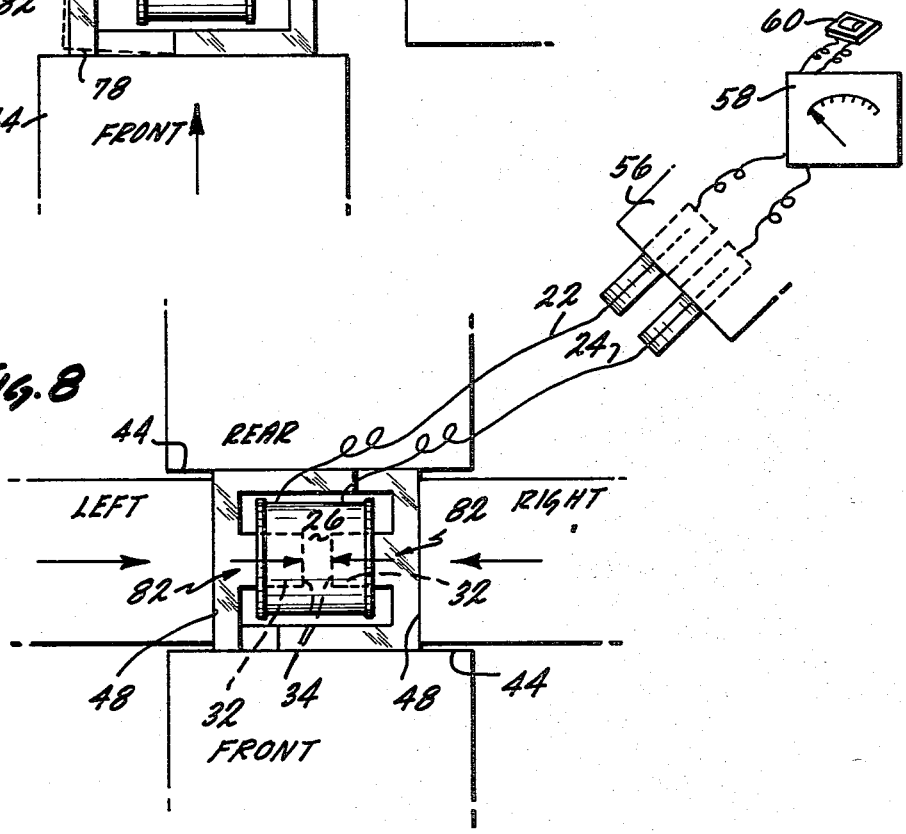
FIG. 8 is a diagram showing a top view of the calibrator bed and showing the second set of jaws being closed to reduce the size of the air gap.

FIGS. 7 and 8 relate to the method and apparatus used to calibrate the inductor; that is, to adjust the width of the air gap of the inductor being calibrated until the inductance of the inductor being calibrated is equal to the inductance of a standard inductor 60. The stacking block shown in FIG. 1 stacks the inductors in a friction-tight open configuration; the air gap is larger than its final value. After the inductor has been plucked from the stacking block and placed in the calibrator bed 42, it is possible that the laminations may be out of alignment as indicated by the dashed lines in FIG. 7. To bring the laminations into alignment, the first set of jaws 44 is closed as shown in FIG. 7 to push the laminations into alignment so that their front edges 78 and their rear edges 80 are brought into registration. Thereafter, the first set of jaws 44 is opened very slightly so as to free the laminations for movement in the left-right direction. Next, as shown in FIG. 8, the ends 22, 24 of the winding of the inductor 26 are attached to the electrical connector block 56 which already is connected to the impedance comparator meter 58.

Next, the operator uses the control handle 50 to close the second set of jaws 48 against the right-hand stack of laminations 82 and the left-hand stack of laminations 84 pushing them closer together as indicated in FIG. 8 and thereby reducing the width of the air gap between the ends 34 of the arms 32 of the laminations. The operator continues to close the second set of jaws 48 until a null reading on the impedance comparator meter 58 indicates that the inductance of the inductor 26 being calibrated is the same as the inductance of the standard inductor 60. The operator may, if he wishes, employ the fine control knob 54 to produce a more gradual and controllable motion of the second set of jaws 48.

Figure 9:
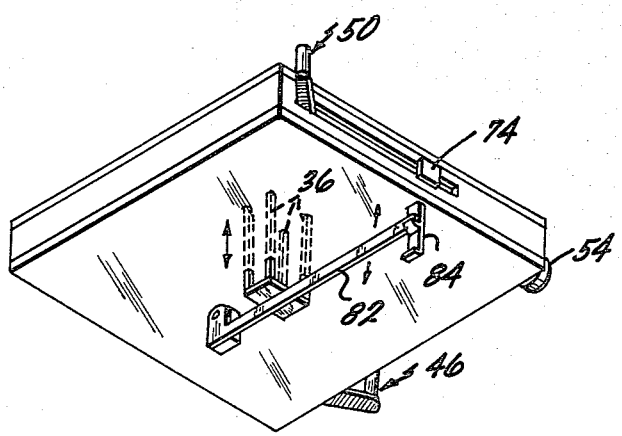
FIG. 9 is a bottom view of a calibrator combined with a stacking block in accordance with an alternative embodiment of the present invention; and, FIG. 10 is a flow chart showing the steps of the method in a preferred embodiment of the present invention.

FIG. 9 is a bottom view of an alternative embodiment of the present invention in which the indexing posts 36 of FIG. 1 are integrated into the calibrator bed 42 of FIG. 3. As shown in FIG. 9, this is accomplished by providing means for elevating and lowering the indexing posts with respect to the substantially flat surface 52 of FIG. 3. In the embodiment shown in FIG. 9, this is accomplished by coupling the indexing posts 36 to an arm 82 which can be used by the operator to elevate and lower the indexing posts 36. The arm 82 is pivotally mounted to the calibrator bed 42 and a catch 84 is provided to support the arm 82 in various elevations. The embodiment of FIG. 9 offers the advantage that the stacked laminations can be left in position for the calibration operation instead of having to be transferred from a separate stacking block to a separate calibrator bed.

Figure 10:
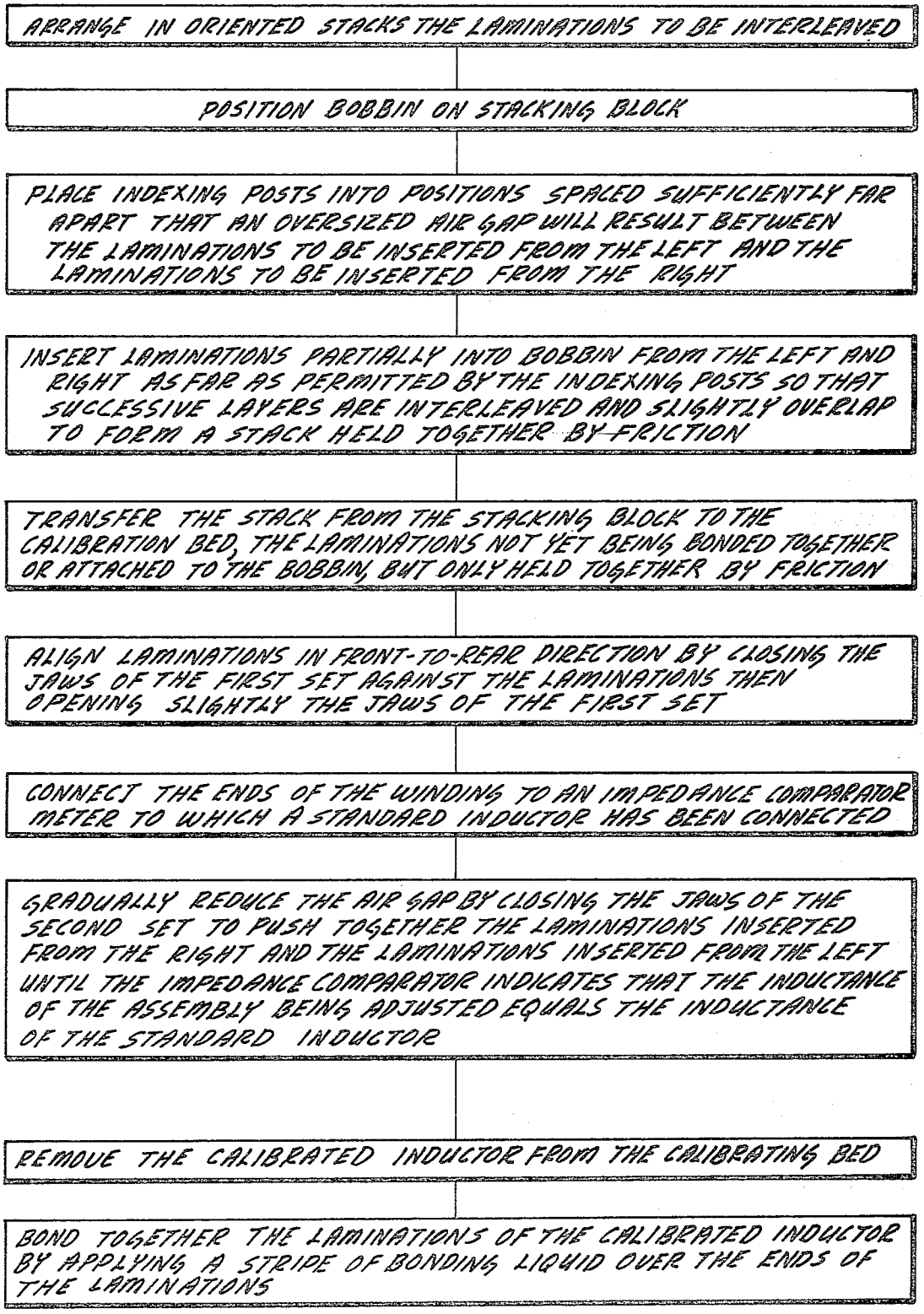

FIG. 10 is a flow chart showing the steps of the method of the present invention in a preferred embodiment.

To facilitate stacking of the laminations into the core 16 of the bobbin 18, the laminations are stacked around the stacking block 10 as shown in FIG. 1, in the orientations they will have when inserted. This elimates the need for the operator to think about which orientation each lamination should have and the need to rotate each lamination individually before inserting it. It should be noted that the stacks of laminations on the right side of the stacking block 10 are rotated 180 degrees with respect to the stacks of laminations on the left side of the stacking block 10, and further, the orientation of the stacks of laminations to the rear of the stacking block 10 are mirror images of the orientations of the stacks in front ot the stacking block 10.

Sitting in front of the stacking block, the operator simultaneously plucks the top lamination from the left front stack and from the right front stack and inserts those laminations into the core 16 of the bobbin 18 in the configuration shown in FIG. *2a*. The laminations are inserted with the arms 32 between the indexing posts 36 and are inserted until the edge 30 of the body 28 of the lamination contacts the indexing posts 36. Next, the operator simultaneously plucks the top lamination from the rear left and rear right stacks and inserts them into the core 16 of the bobbin 18 in the configuration shown in FIG. *2b*. As may be seen in FIG. 1 and deduced from FIGS. *2a* and *2b*, the longer arms 86 which extend from the body 28 of the laminations 14 overlap, at least to some extent, after the laminations have been inserted into the bobbin. This overlap is important since it produces friction which permits the stacked inductor to be handled as though it were a unitary structure.

When the operator has finished stacking all of the laminations, he operates the lever 88 which thrusts the plunger 40 upward to eject the stacked inductor from the stacking block. The stacked inductor is then placed on the calibrator bed 42 of FIG. 3 and the calibration process described above is begun.

The alternative embodiment shown in FIG. 9 may also be supplied with a plunger similar to the plunger 40 shown in FIG. 1 for ejecting the calibrated inductor from the calibrating bed.

The present invention is made practical by the discovery that the friction between the laminations that have been stacked in the bobbin is sufficiently great to permit the stacked and calibrated inductor to be handled without degrading the accuracy with which it has been calibrated. Thus, after the inductor has been calibrated, it is removed from the calibrator bed and transferred to a station to await bonding of the laminations. The laminations of each inductor may be bonded immediately after the inductor has been calibrated, or, alternatively, a group of calibrated inductors can be accumulated and bonded at the same time. As described above, the bonding material is in the form of a thin liquid which, when applied over the ends of the stacked laminations, is drawn by adhesion into the very thin spaces between the laminations and sets up there to hold together the laminations of the calibrated inductor.

The foregoing detailed description is illustrative of a preferred embodiment of the invention and it is to be understood that additional embodiments would be obvious to those skilled in the art. The embodiments described herein, together with those additional embodiments are considered to be within the scope of the invention.

What is claimed is:

1. Apparatus to facilitate manual assembly and subsequent calibration of the type of inductor which includes a wire-wound bobbin having a hollow core extending from left to right for ease of description, and which further includes plate-like laminations each having an arm extending from an edge of the body of the lamination, the arms extending axially into the core from the left and right ends of the core, the ends of the arms being spaced apart to define an air gap within the bobbin, the laminations which extend into the core from the right end being stacked one on top of another with their arms in registration to form a right hand stack, the laminations which extend into the core from the left end being stacked one on top of another with their arms in registration to form a left hand stack, the laminations of the right hand stack being interleaved between the laminations of the left hand stack, said apparatus comprising:

first support means for supporting the bobbin;

second support means including a substantially flat surface surrounding an area recessed below said flat surface to support the stacks of laminations;

a first pair of vertically-extending indexing posts located to the right of the bobbin and spaced sufficiently far apart to permit the arms of the laminations of the right hand stack to be inserted between them into the core of the bobbin;

a second pair of vertically-extending indexing posts located to the left of the bobbin and spaced sufficiently far apart to permit the arms of the laminations of the left hand stack to be inserted between them into the core of the bobbin;

said first pair of indexing posts located far enough to the right of said second pair of indexing posts that after each lamination has been inserted with the edge of its body against said indexing posts, the ends of the arms of the laminations are spaced to provide a predetermined air gap;

said indexing posts extending upwardly from the plane of the substantially flat surface of said second support means while the laminations are being stacked and being movable vertically under control of an operator after the laminations have been stacked to permit movement of the stacked laminations in directions parallel to the substantially flat surface of said second support means;

a first set of vice-like jaws which move along the substantially flat surface of said second support means in a front-rear direction perpendicular to the left-right direction to close against the stacks of laminations under control of an operator to bring the front edges of the laminations into registration and the rear edges of the laminations into registration;

a second set of vice-like jaws which close in the left-right direction along said substantially flat surface to force the right hand stack and the left hand stack together under control of an operator to reduce the width of the air gap;

at least one set of said first and said second set of jaws being less wide than the width of the inductor in a direction perpendicular to the direction of closure, to prevent the sets of jaws from interfering with each other; and further comprising, an impedance comparator electrically connected to the inductor and including a display indicative of the difference between the inductance of the inductor being calibrated and the inductance of a standard inductor as said second set of jaws is closed by the operator, to indicate to the operator when the inductance of the inductor being calibrated is approaching the inductance of the standard inductor.

2. The apparatus of claim 1 wherein the sides of said first and said second pairs of indexing posts adjacent the arms of the laminations are shaped to facilitate insertion of the arms of the laminations and to guide the arms of the laminations as they are being inserted to bring them into registration in the stack with laminations previously inserted.

3. The apparatus of claim 1 further comprising means for ejecting the calibrated inductor from the stacking block.

4. The apparatus of claim 3 wherein said means for ejecting further comprise an upwardly movable plunger located below the inductor.

5. The apparatus of claim 1 further comprising:

a first pinion mounted on said apparatus and rotatable under control of the operator;

a first pair of racks engaging said first pinion on opposite sides of it, each rack connected to a jaw of said first set of jaws for opening and closing said first set of jaws;

a second pinion mounted on said apparatus and rotatable under control of the operator; and, a second pair of racks engaging said second pinion on opposite sides of it, each rack connected to a jaw of said second set of jaws for opening and closing said second set of jaws.

6. The apparatus of claim 5 further comprising precision adjustment means engaging said second pinion and movable by the operator to precisely control rotation of said second pinion, whereby when the inductance of the inductor being calibrated approaches the inductance of the standard inductor, the width of the air gap is reduced under precise control.

7. A calibrator bed to facilitate calibration of the type of inductor which includes a wire-wound bobbin having a hollow core extending from left to right for ease of description, and which further includes plate-like laminations each having an arm extending from an edge of the body of the lamination, the arms extending axially into the core from the left and right ends of the core, the ends of the arms being spaced apart to define an air gap within the bobbin, the laminations which extend into the core from the right end being stacked one on top of another with their arms in registration to form a right hand stack, the laminations which extend into the core from the left end being stacked one on top of another with their arms in registration to form a left hand stack, the laminations of the right hand stack being interleaved between the laminations of the left hand stack, said calibrator bed comprising:

a bed including a substantially flat surface surrounding an area recessed below said surface to support the inductor with the laminations parallel to said surface and with the bottom lamination in each of the stacks resting on the flat surface and with the bobbin extending into the recessed area below the flat surface;

a first set of vice-like jaws which move in the front-rear direction to close along said substantially flat surface against the stacks of laminations under control of an operator to bring the front edges of the laminations into registration and the rear edges of the laminations into registration;

a second set of vice-like jaws which close in the left-right direction along said substantially flat surface to force the right hand stack and the left hand stack together under control of an operator to reduce the width of the air gap;

at least one set of said first and said second set of jaws being less wide than the width of the inductor in a direction perpendicular to the direction of closure, to prevent the sets of jaws from interfering with each other; and further comprising, an impedance comparator electrically connected to the inductor and including a display indicative of the difference between the inductance of the inductor being calibrated and the inductance of a standard inductor as said second set of jaws is closed by the operator, to indicate to the operator when the inductance of the inductor being calibrated is approaching the inductance of the standard inductor.

8. The calibrator bed of claim 7 further comprising:

a first pinion mounted on said calibrator bed and rotatable under control of the operator;

a first pair of racks engaging said first pinion on opposite sides of it, each rack connected to a jaw of said first set of jaws for opening and closing said first set of jaws;

a second pinion mounted on said calibrator bed and rotatable under control of the operator; and, a second pair of racks engaging said second pinion on opposite sides of it, each rack connected to a jaw of said second set of jaws for opening and closing said second set of jaws.

9. The calibrator bed of claim 8 further comprising precision adjustment means engaging said second pinion and movable by the operator to precisely control rotation of said second pinion, whereby when the inductance of the inductor being calibrated approaches the inductance of the standard inductor, the width of the air gap is reduced under precise control.

* * * * *